United States Patent [19]

Tangen

[11] 4,054,961

[45] Oct. 25, 1977

[54] STABILIZING DEVICE FOR AN INFLATABLE RAFT

[75] Inventor: Walter Tangen, Oslo, Norway

[73] Assignee: Gewako S.A., Luxembourg Ville, Luxembourg

[21] Appl. No.: 623,392

[22] Filed: Oct. 17, 1975

[30] Foreign Application Priority Data

Oct. 18, 1974 Norway ..... 74.3779

[51] Int. Cl.[2] ..... B63B 7/08

[52] U.S. Cl. ..... 9/11 A; 9/2 A

[58] Field of Search ..... 9/11 A, 11 R, 2 A, 14, 9/1.3; 272/1 B; 714/123

[56] References Cited

U.S. PATENT DOCUMENTS

| | | | |
|---|---|---|---|
| 2,173,963 | 9/1939 | Eubank | 9/11 A |
| 2,391,906 | 1/1946 | Kearny | 9/2 A |
| 2,584,884 | 2/1952 | Kirby | 9/11 A |
| 3,092,854 | 6/1963 | Manhart | 9/11 A |
| 3,338,266 | 8/1967 | Zilka et al. | 9/11 A X |
| 3,426,942 | 2/1969 | McMains et al. | 9/11 A X |
| 3,605,148 | 9/1971 | Tailer | 9/11 A X |

FOREIGN PATENT DOCUMENTS

| | | | |
|---|---|---|---|
| 1,127,362 | 12/1956 | France | 9/14 |
| 117,095 | 11/1929 | Germany | 9/11 A |

*Primary Examiner*—Trygve M. Blix
*Assistant Examiner*—Sherman D. Basinger
*Attorney, Agent, or Firm*—Watson, Cole, Grindle & Watson

[57] ABSTRACT

An inflatable life raft has an inflatable hose surrounding it, pairs of oppositely arranged, flexible straps tightly interconnecting the hose with the raft and each sloping outwardly of the raft and toward the hose.

5 Claims, 3 Drawing Figures

FIG. 1.
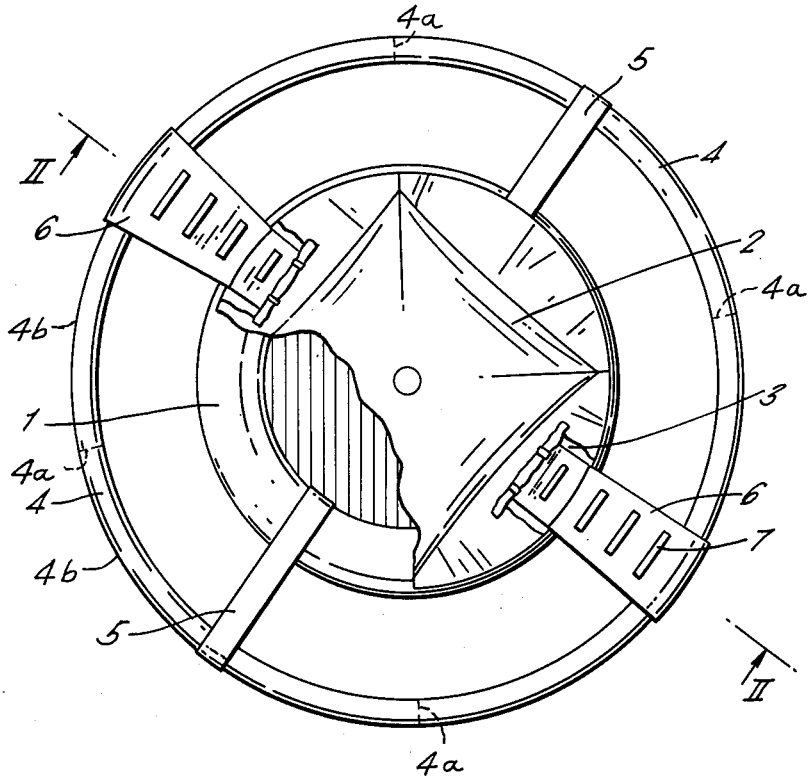
FIG. 2.
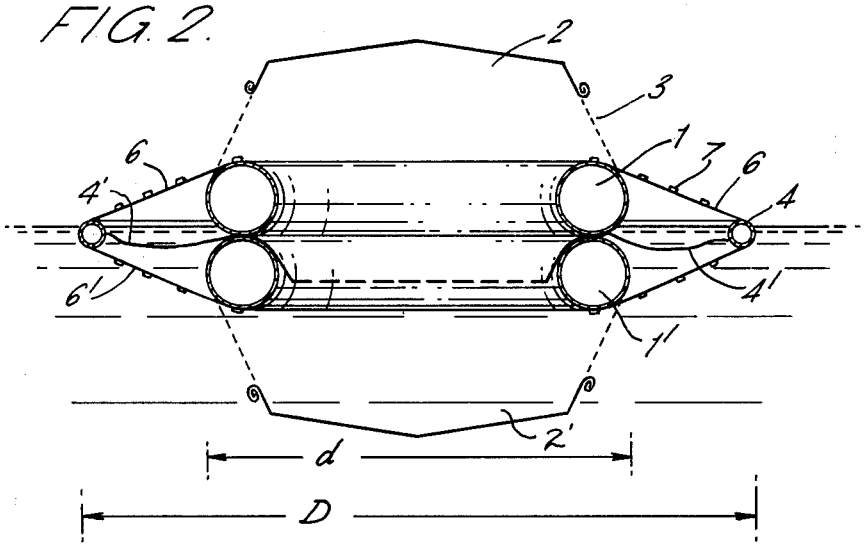
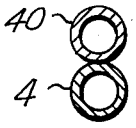
FIG. 3

STABILIZING DEVICE FOR AN INFLATABLE RAFT

The present invention relates to a stabilizing device for life saving rafts. The stabilizing device according to the invention preferably is intended to be used for rafts of the inflatable type but can also be used for rafts of the rigid type. In the following description, however, the stabilizing device is described in connection with a life saving raft of the inflatable type.

Especially for smaller rafts the danger exists that the raft in rough sea is thrown around and capsizes. An object of this invention is to provide a stabilizing device which safeguards salvage material as covered by the present case so that the raft cannot capsize during extreme weather conditions and/or due to a sloping load. The raft is therefore provided with an inflatable, flexible, ring formed hose or tube, the inner diameter or opening of which is substantially greater than the circumference of the raft, the tube thus surrounding the raft at a spaced distance from the circumference thereof. Pairs of flexible straps or the like are provided for firmly securing the hose or tube to the raft in a plane substantially coplanar with the water line plane of the raft, said straps of each pair extending at mutual angles relative to the tube and inwardly toward the raft.

By securing a substantially buoyant ring like hose or tube body to the raft, which tube is arranged at a predetermined distance from the circumference of the raft, it can be seen that a very good safeguarding of the stability of the raft is obtained. The angle between the straps in each pair will prevent the stabilizing ring from being turned up over the raft due to waves or a sloping load of the raft.

The tube body according to the invention can be made as a permanent part of the raft, or it can be arranged as a separate unit which can be installed when it is found desirable.

As far as the prior art is concerned, it should be noted that it is known to enhance the stability of life boats by means of a rigid, ring formed, floating body, which, by means of rigid outriggers, is secured a predetermined distance from the sides of the boat.

The tube of the invention can be inflated from a source of pressure gas on board the raft, or it can be inflated by convenient means which are automatically activated when the raft is launched.

The tube body can be divided into sections or it can be made from two or more parallel tube or hose members. By such division in separate sections any puncture of the tube will not render the whole stabilizing ring useless.

For a better understanding of the invention reference is made to the drawings which schematically show an inflatable life saving raft provided with a stabilizing ring according to the invention.

FIG. 1 is an elevational view of the life saving raft according to the invention.

FIG. 2 is a sectional view taken along the line II—II of FIG. 1. Details as the canopy supporting means, the equipment of the raft, etc., are omitted for the sake of clarity.

FIG. 3 is a sectional view of another embodiment of a stabilizing ring.

In FIG. 1 a ringlike life saving raft of the inflatable type is shown, wherein the buoyancy is obtained by means of two annular hoses or tubes 1, 1' having an outer diameter *d,* and wherein the raft is provided in a known manner with a canopy 2, 2' on each side, so that it does not matter which side of the raft is turned up when it is launched. A ringlike hose body 4 having an outer diameter D, greater than diameter *d,* is arranged at a predetermined distance from the circumference of the raft. The hoselike stabilizing body 4 can be inflated by means of smaller air hoses 4' from a source of pressure gas, for example, serving also for the inflating of raft 1, 1' itself.

The stabilizing ring body 4 is maintained at a desired distance $\frac{1}{2}(D-d)$ around the raft by means of straps 5, 6 which tightly secure ring 4 to the raft so as to provide the desired stabilizing effect for the raft. The straps connecting the hose 4 with the raft 1, 1' are double straps 5, 5' and 6, 6' or arranged in pairs, whereby the desired rigidness is obtained by these connections, the straps of each pair, as will be seen, forming a mutual angle between ring 4 of smaller cross-section and tubes 1, 1' of larger cross-section.

According to a further feature of the invention one or more of the straps 5, 6 are of a substantially greater width than the other shown at 6 in FIG. 1. These broader straps 6 are provided with steps, slits 7 or the like thereby serving as ladders or convenient bridges for a shipwrecked crew who have fallen in the sea and need to climb back on board. These broader straps 6 are arranged to extend through openings 3 of the canopy 2. The stabilizing ring 4 thus will serve not only as a safeguarding stabilizing means for the raft but will also provide the shipwrecked crew a better possibility to enter the raft, the inclined surfaces of straps 6 with steps 7 or the like leading from the ring 4 up to the raft 1 thereby forming a convenient means for climbing on board. The ring 4 will as one will understand during this manoeuvre partly sink down under the surface of the water and will thereby make it easier for climbing on board.

Ring 4 may have a plurality of separators **4*a* therein forming ring sections 4*b*** so that, if less than all of such sections are punctured, the entire ring will not be rendered useless.

Also, the tube body may comprise an additional inflatable ring 40 parallel to ring 4 as shown in FIG. 3.

I claim:

1. An inflatable life raft comprising an inflatable body having a predetermined depth and being capable of floating on a body of water and being of sufficient dimension to support a human being therewithin, an inflatable hose surrounding said body at a spaced distance from the outer circumference thereof, said hose having a depth less than said predetermined depth and likewise being capable of floating on the body of water, pairs of oppositely disposed, flexible straps tightly interconnecting said hose with a top surface of said body whereby said straps each slope toward said hose outwardly of said body.

2. The life raft according to claim 1, wherein at least one of said straps has means on the outer surface thereof for gripping said one strap to thereby assist a re-entry into the raft by a raft occupant who may have fallen overboard.

3. The life raft according to claim 1, wherein at least one air hose, connected with said hose surrounding said body, is provided on said body for inflating said body surrounding hose.

4. The life raft according to claim 1, including means for dividing said hose into at least two separate sections.

5. The life raft according to claim 1, wherein said hose is annular and of circular cross-section, and another hose surrounding said body is disposed parallel thereto.

* * * * *